US008038080B2

(12) United States Patent
Malek et al.

(10) Patent No.: US 8,038,080 B2
(45) Date of Patent: Oct. 18, 2011

(54) FUEL INJECTOR FOR AN INTERNAL COMBUSTION ENGINE

(75) Inventors: Nadim Malek, Versailles (FR); Andre Agneray, Boulogne (FR)

(73) Assignee: RENAULT s.a.s., Boulogne Billancourt (FR)

( * ) Notice: Subject to any disclaimer, the term of this patent is extended or adjusted under 35 U.S.C. 154(b) by 365 days.

(21) Appl. No.: 12/097,310

(22) PCT Filed: Nov. 29, 2006

(86) PCT No.: PCT/FR2006/051247

§ 371 (c)(1),
(2), (4) Date: Sep. 16, 2008

(87) PCT Pub. No.: WO2007/071863

PCT Pub. Date: Jun. 28, 2007

(65) Prior Publication Data

US 2009/0014554 A1 Jan. 15, 2009

(30) Foreign Application Priority Data

Dec. 19, 2005 (FR) ..... 05 12894

(51) Int. Cl.
*B05B 3/04* (2006.01)

(52) U.S. Cl. ..... 239/102.2; 239/102.1; 239/585.1; 239/88

(58) Field of Classification Search ..... 239/102.1, 239/102.2, 585.1, 88
See application file for complete search history.

(56) References Cited

U.S. PATENT DOCUMENTS

| | | | | |
|---|---|---|---|---|
| 5,810,255 | A * | 9/1998 | Itoh et al. | 239/102.2 |
| 6,474,565 | B1 * | 11/2002 | Ruehle et al. | 239/102.1 |
| 6,543,700 | B2 * | 4/2003 | Jameson et al. | 239/102.1 |

FOREIGN PATENT DOCUMENTS

| | | |
|---|---|---|
| EP | 1 277 941 | 1/2003 |
| FR | 2 738 294 | 3/1997 |
| FR | 2 801 346 | 5/2001 |

OTHER PUBLICATIONS

U.S. Appl. No. 12/666,312, filed Dec. 23, 2009, Agneray, et al.
U.S. Appl. No. 11/996,454, filed Apr. 22, 2008, Malek, et al.

* cited by examiner

*Primary Examiner* — Dinh Nguyen
(74) *Attorney, Agent, or Firm* — Oblon, Spivak, McClelland, Maier & Neustadt, L.L.P.

(57) ABSTRACT

A fuel injector for an internal combustion engine, particularly of inwards or outwards opening needle injector type, includes an injector body, e.g., forming a nozzle ending in an injection office, a mechanism for closing off the injection orifice of the injector body, the closing-off mechanism including a vibrating pintle ending in a head for closing off the injection orifice, a return mechanism returning the closing-off to the position in which they close off the injection orifice, and a mechanism for setting the pintle and/or the nozzle into cyclic longitudinal vibration so as to open and close the injection orifice alternately. The fuel injector includes a selectively activatable mechanism immobilizing the pintle with respect to the body.

14 Claims, 3 Drawing Sheets

FUEL INJECTOR FOR AN INTERNAL COMBUSTION ENGINE

BACKGROUND

The present invention relates to a fuel injector for an internal combustion engine, in particular a diesel engine, intended in particular to be used in a motor vehicle.

A conventional internal combustion engine comprises at least one cylinder in which a piston slides between two maximum positions. The piston defines with the cylinder and a cylinder head a combustion chamber. In such an internal combustion engine, the purpose of an injector is to supply finely atomized fuel to the combustion chamber of the internal combustion engine.

From the patent FR 2,801,346 on behalf of the applicant, there is known, for example, an injection device for an internal combustion engine comprising a fuel injector 10 such as illustrated in FIG. 6.

This injector 10 comprises a body 12 including a transducer 14 which can generate vibrations in a longitudinal mode at ultrasonic frequencies. The transducer 14 terminates in the lower portion in a nozzle 16 in which the vibrations coming from the transducer 14 are amplified.

The assembly of the transducer 14 has a first inner cavity 18. The first inner cavity 18 is intended to be filled with pressurized fuel. To do this, the first cavity 18 is connected to a fuel supply hole 20 which can be connected to a pressurized fuel supply circuit (not illustrated). The first cavity 18 emerges at the lower end 22 of the nozzle 16, also called the stem of the injector, through an injection hole.

The injector 10 also includes a pin 24, or needle, lying mainly along the axis y-y'. The pin 24 is installed such that it can move axially inside the nozzle 16. The lower end of the needle 24 has a valve head 26 lying outside the nozzle 16. This valve head 26 is designed to come into contact with the inner surface of the nozzle 16 defining the injection hole of the nozzle 16 so as to close the fuel injection hole.

The other end of the pin is provided with a weight 28 connected elastically by a spring 30 to the body 12 of the injector 10. The system 32 composed of the weight 28 and the spring 30 is installed in a second cavity 34 formed in the rear portion of the body 12 of the injector 10.

The pin 24 and spring 30 assembly, which is elastic, exerts an appropriate elastic return force pressing the valve head 26 of the pin 24 on the area of the nozzle 16 surrounding the injection hole. The applied preloading provides on the one hand the sealing of the injection hole made at the end of the nozzle 16 when the injector 10 is supplied with fuel at a given pressure and on the other hand the adjustment for any wear in the area of contact of the valve head 26 of the pin 24 with the nozzle 16.

The weight 28 is fixed, for example, by screwing to the pin 24 so as to create a mechanical impedance break at the interface between the pin 24 and the weight 28.

The value of the weight 28 and the stiffness of the spring 30 are selected to form a system having a very long response time compared with the excitation times of the transducer 14.

The transducer 14 includes an area composed of a stack 36 of active piezoelectric or magnetostrictive components, which, respectively due to the application of an electric or magnetic field, change in thickness.

This stack 36 is clamped between two other elements 37*a*, 37*b* composed of an elastic material. The connection between the active components is provided by preloading means such as a nut 38. The stack of several active components adds together the changes in thickness generated by each of the active components, the change in thickness resulting from the total movement of the stack of the active components remaining below the limit of elastic deformation of the preloading means.

Due to the application of an electric voltage to the active piezoelectric elements, these elements deform and produce an elastic deformation which is transmitted to the lower end of the nozzle 16.

Preferably, the assembly 40 composed of the transducer 14 and the nozzle 16 is dimensioned to resonate at the excitation frequency of the active components to amplify the longitudinal movements right to the lower end 22 of the nozzle 16. The pin 24, initially closing the injection hole by means of its valve head 26, deforms due to the pulse which is supplied to it when the nozzle 16 starts to oscillate. This deformation spreads elastically along the whole length of the pin 24 and is reflected at the interface 42 between the pin 24 and the weight 28.

The characteristic responses of the pin 24 on the one hand and the nozzle 16 on the other hand make the end of the pin 24 and the opening oscillate with phase and amplitude variation. This variation results in the opening of an annular slit between the pin 24 and the end 22 of the nozzle 16, the width of the slit depending on the phase difference and the relative difference in amplitude between the oscillation of the end 22 of the nozzle 16 and the oscillation of the valve head 26 of the pin 24.

The minimum opening time of the injector 10 is of the same order as the excitation period applied to the transducer, which excitation can take place at several tens of kilohertz, typically 50 kHz, which authorizes a minimum opening time of the order of 20 μs. This makes it possible to deliver quantities of fuel of the order of one microliter during a small period of time.

The body 12 of the injector 10 is intended to be fixed to the upper end of the cylinder head of the engine by means which are not illustrated.

Although the injector 10 has indirect means of setting the pin in longitudinal vibration, also known are injectors comprising direct means of setting the pin in cyclic vibration. In particular, an injector is known comprising a stack of piezoelectric ceramics or a magnetostrictive bar mounted directly in the body of the pin and which excites the pin so as to produce elastic deformations of the pin.

In the two types of excitation, direct or indirect, of the pin of the injector, the pin is embedded at one end in a weight. The function of this weight is to create an impedance break so that the deformation waves being propagated in the pin are reflected at the boundary between the pin and the weight.

Moreover, while the injector 10 is of the outward-opening valve type, injectors of the inward-opening valve type are also known. In the case of an injector of the inward-opening valve type, the pin is pressed, at rest, on the inner face of the lower end of the nozzle due to the action of a spring. The spring is mounted in the second cavity. The closing of the injection hole is thus obtained. When the body of the injector is excited, the pin is set in longitudinal vibration. The end of the pin then oscillates between its position for closing the injection hole and a position for opening this injection hole.

It should be noted that, depending on the type of the injector, the spring exerts, on the pin, either a tensile force (in the case of an injector of the outward-opening valve type) or a compressive force (in the case of an injector of the inward-opening valve type).

However, the dimensions of the injector are fixed by the space available on the engine and in the immediate area around the engine. Thus, the volume of the injector being fixed, the space occupied by the weight+spring system providing a large enough impedance break and a satisfactory sealing force at the injection hole may correspond to a spring with a stiffness such that the weight+spring system has a resonance frequency lying in the excitation range fixed by the vibrations of the engine. An excitation of the weight+spring assembly at its resonance frequency causes the injector to open randomly.

A known solution to this problem consists in adding damping means to the weight+spring system. However, this solution only partially solves the problem of the resonance of the weight+spring system, such an arrangement only reducing the amplitude of the oscillations of the weight+spring system excited at its resonance frequency.

It is also known to fix, to the body of the injector, the weight in which the needle is embedded. However, such a solution has the disadvantage that, because of the heating of the injector and therefore the expansion of the body of the injector and the needle, uncontrolled axial forces occur in the needle. These axial forces disturb the cyclic deformation of the needle and therefore the injection by the injector.

BRIEF SUMMARY

The object of the invention is to provide a fuel injector not having the aforementioned faults and which can, in particular, provide an injection of fuel in the form of fine droplets which is better controlled in relation to the constraints of the area around the injector.

This object of the invention is achieved by means of a fuel injector for an internal combustion engine, in particular of the inward-opening valve type or the outward-opening valve type, including:

- an injector body forming in particular a nozzle terminating in an injection hole;
- means of closing said injection hole of said injector body, said means of closing including a vibrating pin terminating in a valve head for closing said injection hole;
- means of returning said means of closing to the position for closing said injection hole; and
- means of setting said pin and/or said nozzle in cyclic longitudinal vibration so as to alternately open and close the injection hole.

According to the invention, said injector includes selectively activatable means of immobilizing said pin in relation to said body.

Thus, as will be seen in more detail in the remainder of the description, when the means of immobilizing the pin in relation to the body of the injector are activated, the pin does not oscillate and, therefore, any risk of resonance of the pin at vibration frequencies of the engine is removed, which manages the injection. To avoid the problems connected with the differential expansion of the pin and the body of the injector, the means of immobilizing the pin can be deactivated. In that case, the means of returning the means of closing reposition the means of closing in a position where the pin is relieved of the stresses due to the differential expansion of the pin in relation to the body.

Preferably, said selectively activatable means of immobilizing said pin can cooperate with said pin and/or with a weight to which said pin is fixed so as to create a mechanical impedance break.

Preferably, said means of immobilizing include a piston which can slide in a direction generally perpendicular to said pin.

Preferably, the fuel injector according to the invention includes a hydraulic control chamber for controlling the movement of said piston.

Preferably, said hydraulic control chamber includes at least one fuel inlet hole which passes fluid to a fuel supply hole of said injector.

Preferably, said hydraulic control chamber also includes at least one fuel outlet hole, the total cross section of said at least one inlet hole being less than the total cross section of said at least one outlet hole.

Preferably, the fuel injector according to the invention includes means for controlling the filling or the emptying of said hydraulic control chamber of the magnetostrictive or electromagnetic or electrostrictive or piezoelectric type.

Preferably, said means of setting said pin and/or said nozzle in cyclic vibration are of the piezoelectric and/or magnetostrictive and/or electromagnetic type.

Preferably, said means of setting said pin and/or said nozzle in cyclic vibration can cause elastic deformations of said pin and/or said nozzle at ultrasonic frequencies.

Preferably, said means of setting said pin and/or said nozzle in cyclic vibration are solidly mounted on said body and/or said pin.

BRIEF DESCRIPTION OF THE DRAWINGS

Other advantages and features of the invention will emerge from an examination of the description of preferred embodiments which follows, presented only as non-limiting examples, with reference to the attached figures in which.

DETAILED DESCRIPTION

On the figures, the elements which are the same or have the same function are shown with the same reference number.

Figure 1:
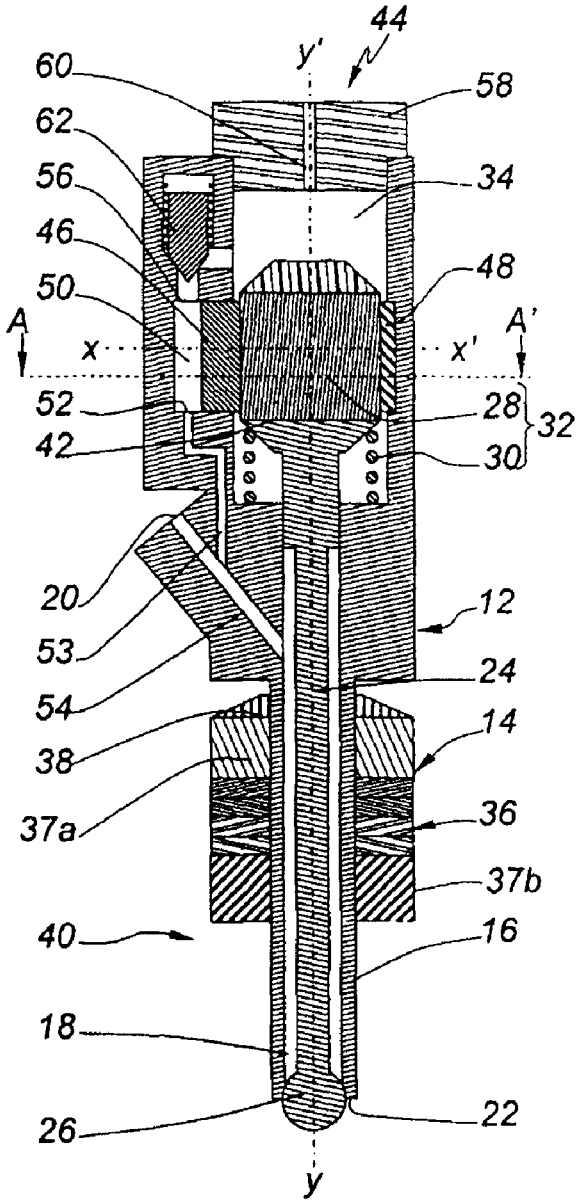
FIG. 1 illustrates a longitudinal cross-section view of an injector according to a first embodiment of the invention.

A first embodiment of the injector 44 according to the invention is illustrated in longitudinal cross section in FIG. 1.

Figure 6:
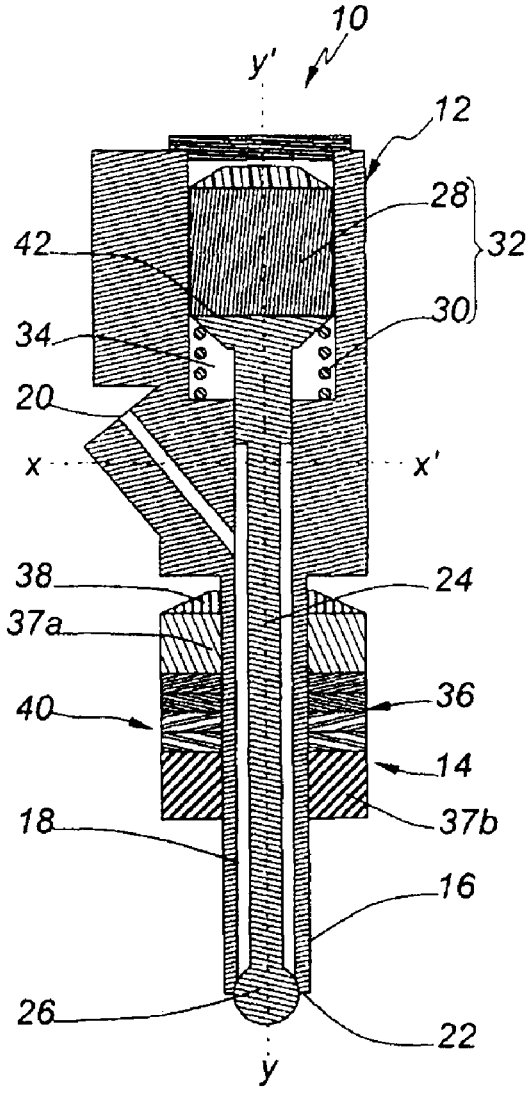
FIG. 6 illustrates a longitudinal cross-section view of an injector according to the prior art.

The elements of the injector 44 according to the first embodiment of the invention which are the same as the elements of the injector of the prior art described above with reference to FIG. 6 are not described again hereinafter.

According to the invention, the injector 44 includes means of immobilizing the weight 28 in relation to the body 12 which are selectively activatable.

These means of immobilizing include a piston 46 mounted such that it is free to move translationally in relation to the body 12 of the injector 44 along an axis x-x' generally perpendicular to the axis y-y' of the pin 24. The means of immobilizing also include a bearing part 48 which can cooperate with the piston 46 so as to stop translation of the weight 28 along the axis y-y'.

Preferably, the piston 46 and/or the bearing part 48 has/have a face for bearing on the weight 28 having a shape which is complementary to that of the weight 28. Thus, the weight 28 being, in this case, cylindrical, the piston 46 and the bearing part 48 have a bearing face which can cooperate with the weight 28 of concave, generally cylindrical, shape. Thus, advantageously, the immobilizing force exerted by the means of immobilizing is optimized for a given pressure.

Preferably, the bearing part 48 is made of hard steel.

Also preferably, the piston 46 and the bearing part 48 are generally of the same height as the weight 28 so as to provide the largest possible contact surface between the piston, the weight and the bearing part. Thus, advantageously, the immobilizing force exerted by the means of immobilizing is optimized for a given pressure.

So as to control the translation of the piston 46, the injector 44 according to the first embodiment of the invention has a hydraulic control chamber 50. This hydraulic control chamber 50 is defined on the one hand by the body 12 of the injector 44 and, on the other hand, by the piston 46. The hydraulic control chamber 50 has a fuel inlet hole 52. A fuel bypass channel 53 is connected to this fuel inlet hole 52. The bypass channel 53 is connected at the other end to the supply channel 54 of the injector 44, preferably between the supply hole 20 and the first cavity 18.

The hydraulic control chamber 50 has moreover a hydraulic fluid outlet hole 56 of which the cross section is, preferably, larger than the cross section of the inlet hole 52. This outlet hole 56 is connected to the second cavity 34. The second cavity 34 is closed by a plug 58. This plug 58 has a low pressure fuel discharge channel 60.

Moreover, so as to control the filling or the emptying of the hydraulic control chamber 50, the injector 44 according to the first embodiment of the invention includes a valve 62, in this case of the electrical control type, preferably of the magnetostrictive, electromagnetic or electrostrictive type. This valve 62 can cut off the passage of fluid between the hydraulic control chamber 50 and the second cavity 34.

The operation and the advantages of the fuel injector 44 according to the first embodiment of the invention result directly from the description of it which has just been given.

When the pressurized fuel enters the body 12 of the injector 44 via the supply hole 20, it spreads through the first cavity 18 and the hydraulic control chamber 50.

When the valve 62 is not electrically fed, it is closed and the passage of fluid between the second cavity 34 and the hydraulic control chamber 50 is interrupted. The fuel is not therefore discharged toward the second cavity 34. The pressure of the fuel in the hydraulic control chamber 50 therefore remains high, that is to say higher than the pressure of the fuel located in the second cavity 34. That is why the fuel pushes the piston 46 along the axis x-x' in the direction of the weight 28. Thus, the piston 46 holds the weight 28 in its initial position by pressing the weight 28 against the bearing part 48. This initial position of the weight 28 and the initial tension in the pin 24 are obtained by construction, in particular by means of the spring 30 disposed in the second cavity 34.

When the valve 62 is electrically fed, it opens. The fuel is then discharged toward the second cavity 34. The pressure in the hydraulic control chamber 50 then drops and the piston 46 relaxes its hold. The weight 28 is released and the tension in the pin 24 resumes the value that the spring 30 imparts to it.

This activation of the opening of the valve 62 occurs at regular intervals (for example every minute) and for very short times, of the order of a few hundred milliseconds, in order to enable the tension in the pin 24 to resume the value imparted by the spring 30, and eliminate excess tension which can occur in the pin 24 due to differential expansions of the body 12 of the injector 44 and the pin 24. The opening of this valve 62 can, for example, be carried out between two successive injections.

It should be noted that the fuel, which is always supplied under pressure by a pump, continues to exert a pressure on the piston 46. Therefore, in spite of the opening of the valve 62, the fuel can tend to maintain a pressure, in the hydraulic control chamber 50, higher than the pressure in the second cavity 34. This problem is solved by the fact that the arrival of the fuel in the hydraulic control chamber 50 takes place via a narrow bypass channel 53, and that the discharging of the fuel from the hydraulic control chamber 50 is carried out by means of a discharge hole 56 and a discharge channel 60 of larger diameter than the diameter of the bypass channel 53. Thus, the pressure drop when discharging the fuel from the control chamber 50 is less than the pressure drop when filling this control chamber 50. It is thus possible to facilitate the discharging of the fuel from the control chamber 50 so as to reduce, very rapidly, the pressure of the fuel in the control chamber 50.

The valve 62 preferably gives a small pressure drop in order that the pressure in the hydraulic control chamber 48 drops rapidly. The bypass channel 53 adequately prevents the pressure rise in the hydraulic control chamber 50 from rising again. Thus, the pressure of the fuel in the hydraulic control chamber 50 does not have time to rise to prevent the release of the weight 28.

Figure 2:
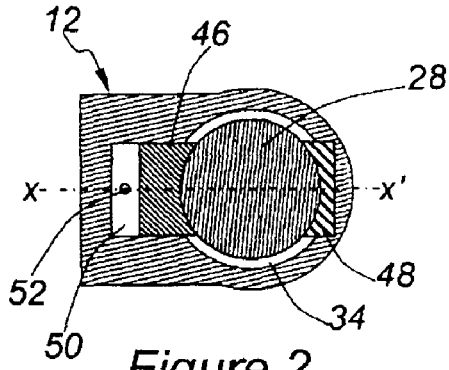
FIG. 2 illustrates a cross-section view along the cross-section plane A-A of the injector in FIG. 1.

When the valve 62 is no longer fed, it closes so as to stop the passage of fluid between the hydraulic control chamber 50 and the second cavity 34. The pressure in the hydraulic control chamber 50 then increases. The piston 46 is then pressed on the weight 28 against the bearing part 48 so as to immobilize the weight 28, as illustrated in FIG. 2. Immediately after immobilization, the force in the pin 24 has the value that the spring 30 imparts, the pin 24 being relieved of additional forces which could have been created as a result of differential expansions.

Figure 3:
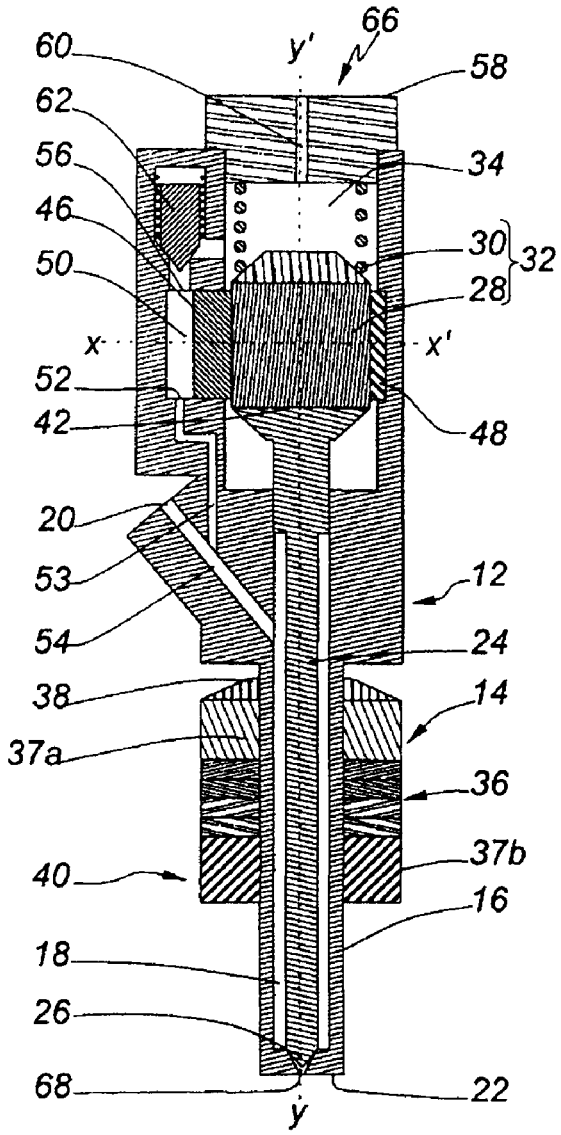
FIG. 3 illustrates a longitudinal cross-section view of an injector according to a second embodiment of the invention.

FIG. 3 shows a second embodiment of the injector according to the invention. The injector 66 illustrated in FIG. 3 is different from the injector 44 according to the first embodiment of the invention in that it is an injector of the inward-opening valve type. Thus, in order to close the injection hole 68, the pin 24 is pressed, at rest, on the inner face of the lower end 22 of the nozzle 16 due to the action of the spring 30 which is mounted in the second cavity 34.

Figure 4:
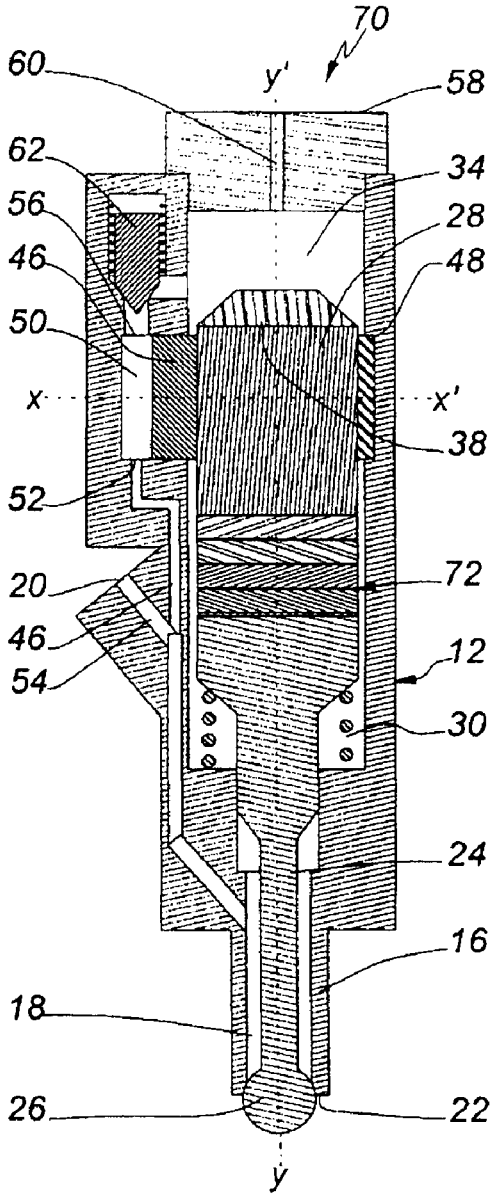
FIG. 4 illustrates a longitudinal cross-section view of an injector according to a third embodiment of the invention.

FIG. 4 shows a third embodiment of the injector according to the invention. The injector 70 illustrated in FIG. 4 is different from the injector 44 according to the first embodiment in that it does not have a stack 36 of active components, for example piezoelectric or magnetostrictive components, mounted on the body of the injector. In fact, a stack 72 of active components which can deform due to the action of an electric or magnetic field, preferably piezoelectric or magnetostrictive components, is solidly mounted on the pin 24 so that the deformation of this stack 72 of active components directly causes the setting in longitudinal vibration of the pin 24.

Figure 5:
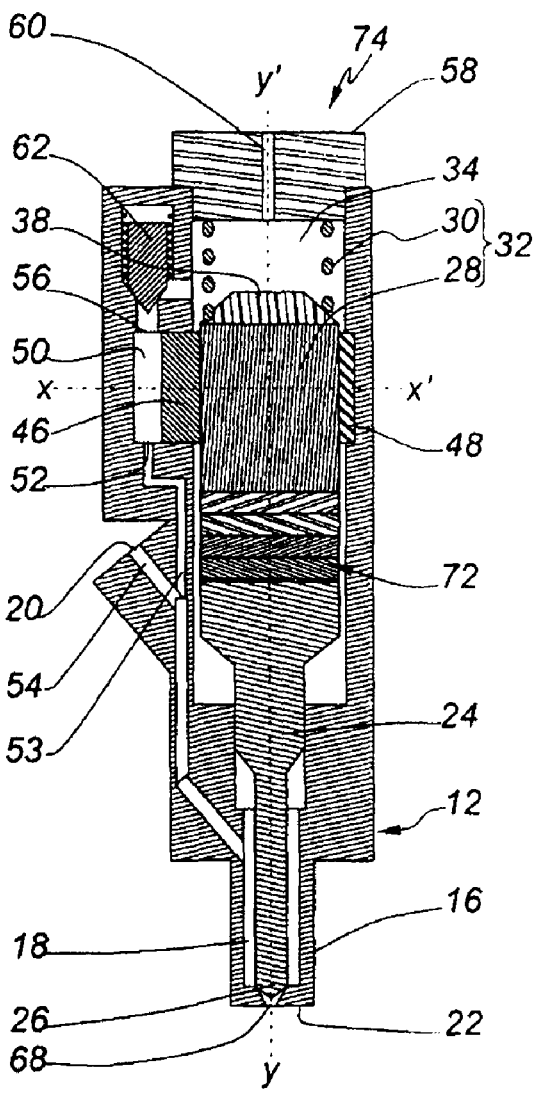
FIG. 5 illustrates a longitudinal cross-section view of an injector according to a fourth embodiment of the invention.

FIG. 5 shows a fourth embodiment of the injector according to the invention. The injector 74 illustrated in FIG. 5 is different from the injector 66 according to the second embodiment in that it does not have a stack 36 of active components, for example piezoelectric or magnetostrictive components, mounted on the body of the injector. In fact, as has been described for the injector 70 according to the third embodiment, a stack 72 of active components which can deform due to the action of an electric current, for example piezoelectric or magnetostrictive elements, is solidly mounted on the pin 24 so that the deformation of this stack 72 of active components directly causes the setting in longitudinal vibration of the pin 24.

Of course, the present invention is not restricted to the embodiments presented above as illustrative and non-limiting examples and many modifications are possible without departing from the scope of the invention.

Thus, the immobilizing piston and the bearing part can cooperate directly with the pin, the weight then possibly being able to be omitted.

Moreover, although the device formed of the piston 46 and bearing part 48 is an advantageous embodiment of selectively activatable means of immobilizing, these elements can be replaced by any selectively activatable device effectively able to carry out the immobilizing of the weight and/or the pin. In particular, as examples, an electric or hydraulic actuator or a system of immobilizing by an electromagnet can be mentioned.

The invention claimed is:

1. A fuel injector for an internal combustion engine, comprising:

an injector body forming a nozzle terminating in an injection hole;

means for closing the injection hole of the injector body, the means for closing including a vibrating pin terminating in a valve head for closing the injection hole;

means for returning the means for closing to a position for closing the injection hole;

means for setting the pin and/or the nozzle in cyclic longitudinal vibration so as to alternately open and close the injection hole;

selectively activatable means for immobilizing the pin in relation to the body, wherein the selectively activatable means for immobilizing includes a piston that slides in a direction generally perpendicular to an axis of the pin; and a hydraulic control chamber that fills with fluid to bias the piston towards the pin.

2. The fuel injector as claimed in claim 1, wherein the selectively activatable means for immobilizing the pin can cooperate with the pin and/or with a weight to which the pin is fixed so as to create a mechanical impedance break.

3. The fuel injector as claimed in claim 1, wherein the hydraulic control chamber includes at least one fuel inlet hole that passes fluid to a fuel supply hole of the injector.

4. The fuel injector as claimed in claim 3, wherein the hydraulic control chamber further includes at least one fuel outlet hole, a total cross section of the at least one inlet hole being less than a total cross section of the at least one outlet hole.

5. The fuel injector as claimed in claim 3, further comprising means for controlling filling or emptying of the hydraulic control chamber of magnetostrictive or electromagnetic or electrostrictive or piezoelectric type.

6. The fuel injector as claimed in claim 1, wherein the means for setting the pin and/or the nozzle in cyclic vibration are of piezoelectric and/or magnetostrictive and/or electromagnetic type.

7. The fuel injector as claimed in claim 1, wherein the means for setting the pin and/or the nozzle in cyclic vibration can cause elastic deformations of the pin and/or the nozzle at ultrasonic frequencies.

8. The fuel injector as claimed in claim 1, wherein the means for setting the pin and/or the nozzle in cyclic vibration are solidly mounted on the body and/or the pin.

9. The fuel injector as claimed in claim 1, further comprising a bearing part configured to cooperate with the piston to immobilize the pin.

10. A fuel injector for an internal combustion engine, comprising:

an injector body that forms a nozzle terminating in an injection hole;

a vibrating pin terminating in a valve head that closes the injection hole;

a spring that returns the vibrating pin to a position that closes the injection hole;

a stack of active components that sets the pin in cyclic longitudinal vibration so as to alternately open and close the injection hole;

a piston that slides in a direction generally perpendicular to an axis of the pin to immobilize the pin; and a hydraulic control chamber that fills with fluid to bias the piston towards the pin.

11. The fuel injector as claimed in claim 10, wherein the piston slides in the direction generally perpendicular to the axis of the pin such that an end of the piston contacts a side of the pin to immobilize the pin.

12. The fuel injector as claimed in claim 10, wherein the hydraulic control chamber includes at least one fuel inlet hole that passes fluid to a fuel supply hole of the injector.

13. The fuel injector as claimed in claim 12, wherein the hydraulic control chamber further includes at least one fuel outlet hole, a total cross section of the at least one inlet hole being less than a total cross section of the at least one outlet hole.

14. The fuel injector as claimed in claim 10, further comprising a bearing part configured to cooperate with the piston to immobilize the pin.

* * * * *